United States Patent [19]

Nakamura et al.

[11] 4,389,540

[45] Jun. 21, 1983

[54] ADAPTIVE LINEAR PREDICTION FILTERS

[75] Inventors: Makoto Nakamura, Kanagawa; Fumio Sugiyama, Sagamihara, both of Japan

[73] Assignee: Tokyo Shibaura Denki Kabushiki Kaisha, Kawasaki, Japan

[21] Appl. No.: 245,435

[22] Filed: Mar. 19, 1981

[30] Foreign Application Priority Data

Mar. 31, 1980 [JP] Japan ..... 55-41574

[51] Int. Cl.[3] ..... G10L 1/00

[52] U.S. Cl. ..... 179/1.5 A; 364/724

[58] Field of Search ..... 179/1.5 A, 1.5 B, 1.5 C, 179/1.5 D, 1.5 M, 1 D; 364/513, 724

[56] References Cited

U.S. PATENT DOCUMENTS 3,662,115 5/1972 Saito et al. ..... 179/1.5 A

FOREIGN PATENT DOCUMENTS 2026289 11/1979 United Kingdom ..... 179/1.5 A

OTHER PUBLICATIONS

"Digital Filtering Techniques for Speech Analysis and Synthesis" by F. Itakura and S. Saito, 7th International Congress on Acoustics 1971.

"A Speech Digitizer at 2400 Bits/s" by S. Maitra and C. R. Davis, IEEE Transactions on Acoustics, Speech and Signal Processing, vol. ASSP-27, No. 6, Dec. 6, 1979, pp. 729-733.

*Primary Examiner*—Emanuel S. Kemeny

*Attorney, Agent, or Firm*—Oblon, Fisher, Spivak, McClelland & Maier

[57] ABSTRACT

An improved linear prediction filter based on the PARCOR lattice structure of Itakuro and Saito, replaces the correlator by a recursive loop including a coefficient generator, coefficient corrector, and attenuator, such that the corresponding filter output is suppressed to a minimum value.

31 Claims, 23 Drawing Figures

ADAPTIVE LINEAR PREDICTION FILTERS

The present invention relates to a voice analyzing apparatus which can be employed in voice recognition and voice analyzing-synthesizing systems.

There have been widely used these days voice synthesizing systems in which voice is analyzed to plural groups of basic parameters and these parameter data are transmitted at a low bit rate on the transmitting side thereof while parameter data received are re-composed to synthesize the voice on the receiving side thereof, and voice recognition apparatus for picking out basic parameters of voice so as to recognize the spoken word.

There is well known the voice analyzing apparatus in which partial autocorrelation coefficient representing the correlation between adjacent sampling values of voice signal is picked out, as one of basic parameters of voice. Partial autocorrelation coefficient between sampling values of voice signal obtained at two successive sampling time points is expressed by the correlation of differences between sampling values practically obtained at these two sampling time points and predicted values at these two sampling time points, the predicted values being predicted from sampling values obtained between these two sampling time points.

U.S. Pat. No. 3,662,115, for example, discloses a voice analyzing apparatus capable of picking out this partial autocorrelation coefficient. As shown in FIG. 1, this voice analyzing apparatus includes P number of cascade-connected delay filter circuits 10-1 to 10-P. A voice signal input terminal $VS_{IN}$ is connected to input terminals of first stage delay filter circuit 10-1. Each of delay filter circuits 10-1 to 10-P has the same arrangement and achieves substantially the same operation. Therefore, arrangement and operation of voice analyzing apparatus will be described referring to the i-th delay filter circuit 10-i, for example.

As shown in FIG. 1, the delay filter circuit 10-i has first and second input terminals 11-i and 12-i connected to two output terminals of preceding stage delay filter circuit, respectively. Voice input signal components received at the first input terminal 11-i are delayed by a time T through a delay circuit 13-i, the time T being equal to the time space between adjacent sampling time points, and then supplied to first adder 14-i, correlator 15-i and first multiplier 16-i. Voice input signal components received at the second input terminal 12-i are supplied to correlator 15-i, second adder 17-i and second multiplier 18-i. The correlator 15-i calculates the correlation coefficient between output signals of delay circuit 13-i and voice input signal components received at the second input terminal 12-i, and supplies this calculation result to multipliers 16-i and 18-i. The first multiplier 16-i supplies the product of output signals of delay circuit 13-i and correlator 15-i to the negative input terminal of adder 17-i, and the second multiplier 18-i supplies the product of voide input signal component received at the second input terminal 12-i and of output signal of correlator 15-i to the negative input terminal of adder 14-i. The first adder 14-i generates a signal representing the difference between output signals of delay circuit 13-i and second multiplier 18-i, while the second adder 17-i a signal representing the difference between output signal of first multiplier and voice input signal component received at the second input terminal 12-i. Output signals of adders 14-i and 17-i are supplied as backward and forward prediction error signals of delay filter circuit 10-i to a next delay filter circuit.

Voice signal received at the voice signal input terminal $VS_{IN}$ is supplied to two input terminals of first stage delay filter circuit 10-l, so that the partial autocorrelation coefficient of two sampling values having the time interval T can be obtained from the correlation output terminal CT-l of correlator (not shown) of delay filter circuit 10-1 while the partial autocorrelation coefficient of two voice sampling values having a time interval iT can be obtained from the correlation output terminal CT-i of correlator 15-i of delay filter circuit 10-i. The correlation between sampling values of voice signal at adjacent sampling time points is reduced as it comes to later stages, and information corresponding to fundamental frequency of voice signals can be obtained from the first and second adders (not shown) of last stage delay filter circuit 10-P.

In the case of conventional voice analyzing apparatus as described above, the correlator 15 for operating the analog correlation of two sampling values needed comparatively large space to make the whole of voice analyzing apparatus large-sized. As shown in FIG. 2, the correlator 15-i comprises adders 151-i and 152-i for adding and subtracting output signals of delay circuit 13-i and voice input signal components received at the input terminal 12-i, squaring circuits 153-i and 154-i for squaring output signals of adders 151-i and 152-i, adders 155-i and 156-i for subtracting and adding output signals of squaring circuits 153-i and 154-i, low pass filters 157-i and 158-i for determining mean values of output signals of adders 155-i and 156-i, and a divider 159-i for calculating the ratio of output signals applied from low pass filters 157-i and 158-i and sending it through the output terminal CT-i thereof. The operation of correlator 15-i is omitted here because it is well known as described in U.S. Pat. No. 3,662,115, for example.

The correlator 15-i shown in FIG. 2 needs relatively large space in which squaring circuits or multipliers 153-i and 154-i, low pass filters 157-i and 158-i, and divider 159-i are to occupy. It is therefore necessary to make the correlator 15-i small-sized that circuit elements are reduced in number or removed completely.

The object of the present invention is to provide a voice analyzing apparatus comparatively simple in construction and capable of reliably picking partial autocorrelation coefficient out of voice input signals.

The object of the present invention is achieved by a voice analyzing apparatus comprising a plurality of cascade-connected delay filter circuits; each of cascade-connected delay filter circuits including a delay circuit for delaying an input signal received at the first input terminal thereof by a predetermined period of time, a variable coefficient generating circuit, a first multiplier circuit for producing an output signal corresponding to the product of output signals of delay circuit and variable coefficient generating circuit, a second multiplier circuit for producing an output signal corresponding to the product of an output signal of variable coefficient generating circuit and an input signal received at the second input terminal thereof, a first adder circuit for producing an output signal corresponding to the sum or difference between output signals of delay circuit and second multiplier circuit, a second adder circuit for producing an output signal corresponding to the sum or difference between an output signal from the first multiplier circuit and an input signal received at the second input terminal thereof, and a coefficient correction circuit for changing a coefficient output signal generated through the variable coefficient generating circuit to suppress at least one of output signals applied from first and second adder circuits to minimum.

Variable coefficient generating circuit and coefficient correction circuit employed in the present invention can be formed by a smaller number of comparatively small space-occupying circuit elements, thus making it possible to substantially simplify the voice analyzing apparatus.

This invention can be more fully understood from the following detailed description when taken in conjunction with the accompanying drawings, in which.

Figure 3:
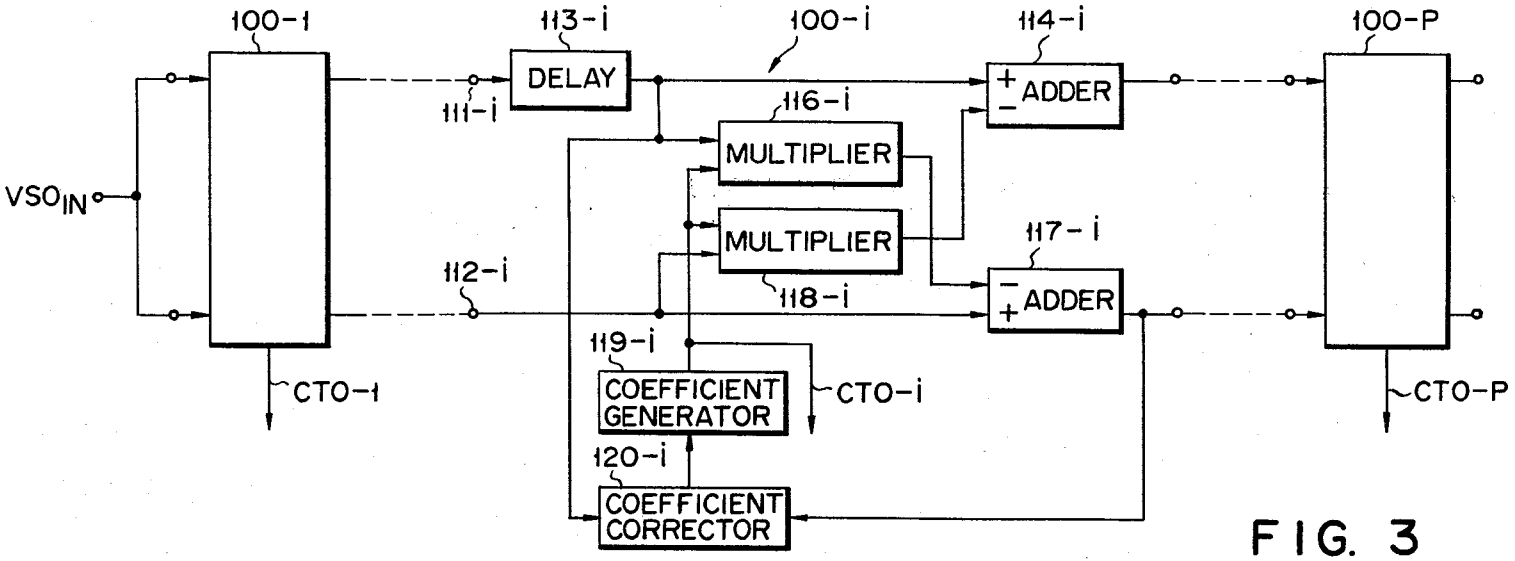
FIG. 3 is a block diagram showing an example of voice analyzing apparatus embodied according to the present invention and formed of a plurality of cascade-connected delay filter circuits.

FIG. 3 is a block diagram showing an example of voice analyzing apparatus embodied according to the present invention. This voice analyzing apparatus includes P number of cascade-connected delay filter circuits or partial autocorrelation detector circuits 100-l to 100-P. Connected to input terminals of a first delay filter circuit 100-l is a voice input terminal $VSO_{IN}$, to which are supplied digital signals representing voice signals sampled at a predetermined sampling rate. Each of these delay filter circuits 100-l to 100-P has the same arrangement and achieves substantially the same operation. Therefore, an i-th delay filter circuit 100-i will be now described to show the arrangement and operation of voice analyzing apparatus.

Figure 1:
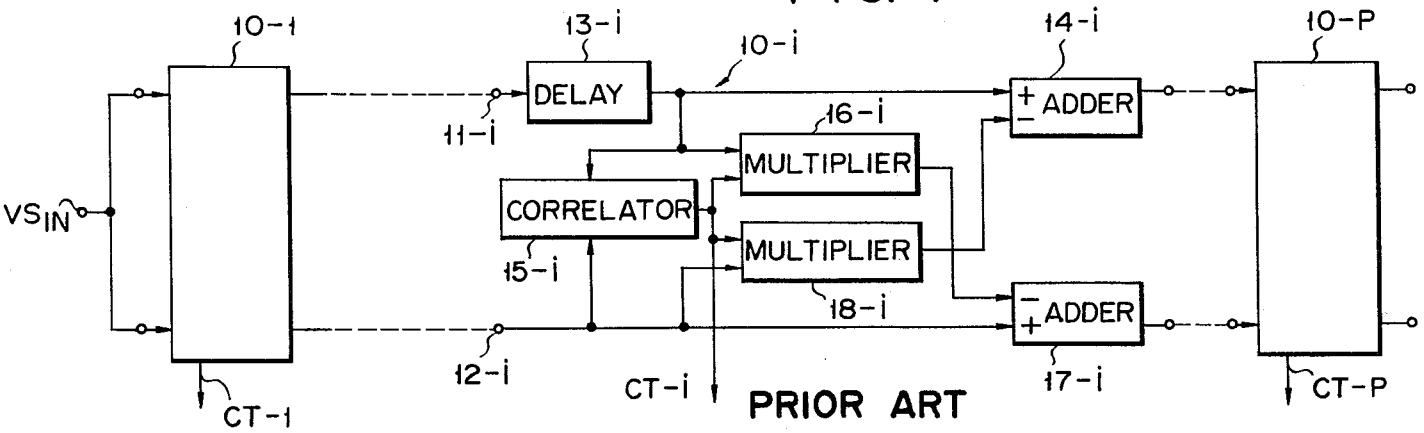
FIG. 1 PRIOR ART
FIG. 1 is a block diagram showing the conventional voice analyzing apparatus which includes a plurality of cascade-connected delay filter circuits.
Figure 2:
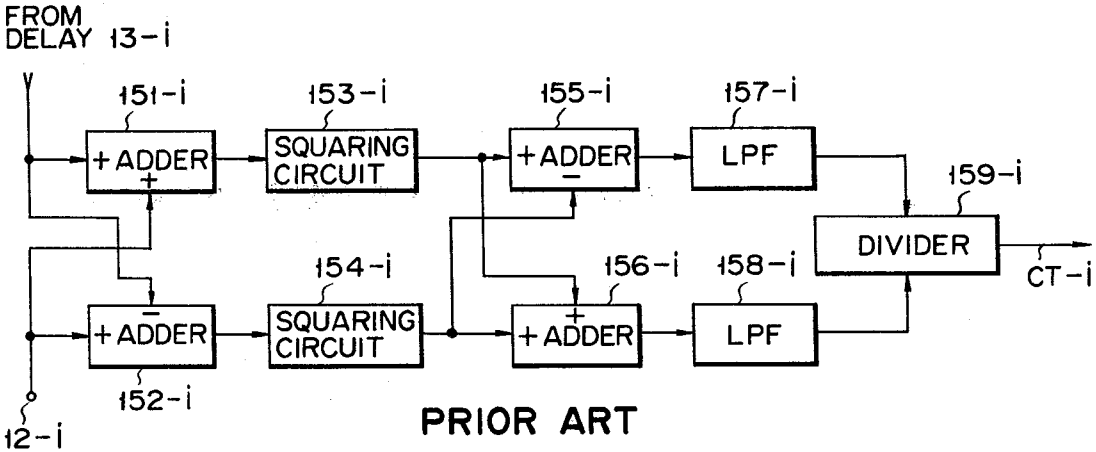
FIG. 2 PRIOR ART
FIG. 2 is a block diagram of correlator employed in delay filter circuits shown in FIG. 1.

As shown in FIG. 3, the delay filter circuit 100-i has the same arrangement as that of the delay filter circuit 10-i shown in FIG. 1, but is different in that a combination of variable coefficient generating circuit 119-i and coefficient correction circuit 120-i is used instead of correlator 15-i. Namely, this delay filter circuit 100-i includes a delay circuit 113-i which serves to delay a voice input signal component received at the first input terminal 111-i thereof by a time period T equal to the time interval of two successive sampling times, and then to supply it to a first adder 114-i and a first multiplier 116-i. Voice input signal components received at a second input terminal 112-i are supplied to a second adder 117-i and a second multiplier 118-i. The first multiplier 116-i generates an output signal representing the product of output signals of delay circuit 113-i and coefficient generating circuit 119-i, and the second multiplier 118-i generates an output signal representing the product of output signal of variable coefficient generating circuit 119-i and input signal received at the input terminal 112-i. The first adder 114-i supplies an output signal to the first input terminal of a next delay filter circuit (not shown), the output signal representing the difference between output signals of delay circuit 113-i and second multiplier 118-i, and the second adder 117-i supplies an output signal to the second input terminal of next delay filter circuit (not shown), the output signal representing the difference between the input signal received at the second input terminal 112-i and the output signal of first multiplier 116-i.

A coefficient correcting circuit 201-i receives output signals of the delay circuit 113-i and the second adder 117-i and controls the variable coefficient generating circuit 119-i so as to suppress the output signal of the second adder 117-i to a minimum value, whereby the coefficient output signal generated from the variable coefficient generating circuit 119-i is iteratively corrected and converged to a predetermined value as time passes. For example, output signals K1i obtained from the variable coefficient generating circuit 119-i of the i-th delay filter circuit 100-i of voice analyzing apparatus shown in FIG. 3 become equal to output signals K2i obtained from the correlation circuit 15-i of the i-th delay filter circuit 10-i of voice analyzing apparatus shown in FIG. 1, and output signals of the first and second adders 114-i and 117-i become equal to backward and forward prediction error signals obtained from the first and second adders 14-i and 17-i.

Assume now that backward prediction error signal $x_{(i-1)}(n)$ at a (i−1)th stage is generated through the delay circuit 13-i of the i-th delay filter circuit of voice analyzing apparatus shown in FIG. 1, and forward prediction error signal $y_{(i-1)}(n)$ at a (n−1)th stage is supplied to the second input terminal 12-i, and that output signal $x_{(i-1)}(n)$ is generated through the delay circuit 113-i of the i-th delay filter circuit 100-i of voice analyzing apparatus shown in FIG. 3, and input signal $y_{(i-1)}(n)$ is supplied to the second input terminal 112-i. Then, an output signal K2i of the correlator 15-i shown in FIG. 1 or partial autocorrelation coefficient at the i-th stage will be given as follows:

$$K2i = \frac{E\{x_{(i-1)}(n) \cdot y_{(i-1)}(n)\}}{[E\{x_{(i-1)}(n)^2\} \cdot E\{y_{(i-1)}(n)^2\}]^{\frac{1}{2}}} \quad (1)$$

It is well known that expected value $E\{x_{(i-1)}(n)\}$ of forward prediction error at the (i−1)th stage is equal to the expected value $E\{y_{(i-1)}(n)\}$ of forward prediction error. The equation (1) will be therefore changed as follows:

$$K2i = \frac{E\{x_{(i-1)}(n) \cdot y_{(i-1)}(n)\}}{E\{x_{(i-1)}(n)^2\}} \quad (2)$$

-continued $$= \frac{E\{x_{(i-1)}(n) \cdot y_{(i-1)}(n)\}}{E\{y_{(i-1)}(n)^2\}}$$

Output signal $e_i(n)$ of the second adder 117-i shown in FIG. 3 is expressed as follows:

$$e_i(n) = y_{(i-1)}(n) - x_{(i-1)}(n) \cdot K1i \quad (3)$$

When K1i is time-sequentially corrected according to an iterative method to minimize the time average of the square of value $e_i(n)$, K1i is converged to such a value as to meet the following equation.

$$\frac{\partial}{\partial K1i} \overline{\{e_i(n)^2\}} = \overline{2e_i(n) \cdot \{-x_{(i-1)}(n)\}} = \overline{2\{y_{(i-1)}(n) - x_{(i-1)}(n) \cdot K1i\} \cdot \{-x_{(i-1)}(n)\}} = 0 \quad (4)$$

Therefore, $$K1i = \frac{\overline{x_{(i-1)}(n) \cdot y_{(i-1)}(n)}}{\overline{x_{(i-1)}(n)^2}} \quad (5)$$

Signals $x_{(i-1)}(n)$ and $y_{(i-1)}(n)$ are ergodic. The time average value of these signals becomes therefore equal to the expected value thereof. Accordingly, $$\frac{E\{x_{(i-1)}(n) \cdot y_{(i-1)}(n)\}}{E\{x_{(i-1)}(n)^2\}} = \frac{\overline{x_{(i-1)}(n) \cdot y_{(i-1)}(n)}}{\overline{x_{(i-1)}(n)^2}} \quad (6)$$

Therefore, output signal K1i obtained from the variable coefficient generating circuit 119-i of the i-th delay filter circuit 100-i shown in FIG. 3 becomes equal to partial autocorrelation coefficient K2i obtained from the i-th delay filter circuit 10-i shown in FIG. 1. Output signals $x_i(n)$ and $y_i(n)$ obtained from the first and second adders 114-i and 115-i shown in FIG. 3 are respectively expressed as follows:

$$x_i(n) = x_{(i-1)}(n) - K1i \cdot y_{(i-1)}(n) = x_{(i-1)}(n) - K2i \cdot y_{(i-1)}(n) \quad (7)$$

$$y_i(n) = y_{(i-1)}(n) - K1i \cdot x_{(i-1)}(n) = y_{(i-1)}(n) - K2i \cdot x_{(i-1)}(n) \quad (8)$$

As apparent from these equations (7) and (8), output signals obtained from first and second adders 114-i and 116-i shown in FIG. 3 after K1i is converged to a certain value become theoretically equal to backward and forward prediction error signals generated through the first and second adders 14-i and 16-i.

As described above, the voice analyzing apparatus shown in FIG. 3 achieves the same operation in principle as the one shown in FIG. 1, and causes the delay filter circuit at every stage to generate output signals same as partial autocorrelation coefficient, backward and forward prediction error signals obtained from the corresponding delay filter circuit of apparatus shown in FIG. 1.

Figure 4:
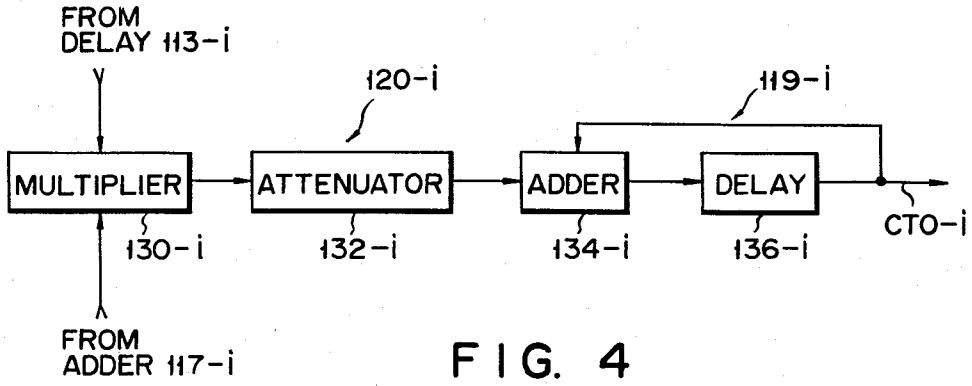
FIG. 4 is a block diagram showing variable coefficient generating circuit and coefficient correction circuit employed in the delay filter circuits of FIG. 3.

FIG. 4 shows more concretely the variable coefficient generating circuit 119-i and coefficient correction circuit 120-i both employed in the voice analyzing apparatus shown in FIG. 3. The coefficient correction circuit 120-i includes a multiplier 130-i for receiving an output signal $x_{(i-1)}(n)$ of the delay circuit 113-i and an output signal $e_i(n)$ of the second adder 117-i to generate an output signal $\{x_{(i-1)}(n) \cdot e_i(n)\}$, and an attenuation circuit 132-i for attenuating the output signal of multiplier 130-i to generate an output signal $\{g_i \cdot x_{(i-1)}(n) \cdot e_i(n)\}$. The variable coefficient generating circuit 119-i has an adder 134-i for receiving the output signal from the attenuator circuit 132-i of coefficient correction circuit 120-i, and a delay circuit 136-i for delaying the output signal of the adder 134-i by a time period T to supply it as an output signal K1i to another input terminal of adder 134-i as well as to an output terminal CT0-i thereof.

An output signal $\{g_i \cdot x_{(i-1)}(n) \cdot e_i(n)\}$ of the attenuator circuit 132-i is added to an output signal K1i(n) now being generated through the delay circuit 136-i, and then supplied to the delay circuit 136-i. Therefore, an output signal K1i(n+1) obtained from the delay circuit 136-i at a next time slot (n+1) is given as follows:

$$K1i(n+1) = K1i(n) + g_i \cdot x_{(i-1)}(n) \cdot e_i(n) \quad (9)$$

Attention should be paid here to the matter that since output signal $\{g_i \cdot x_{(i-1)}(n) \cdot e_i(n)\}$ of the coefficient correction circuit 120-i is constant times the differential value of $e_i(n)^2$ with respect to K1i, K1i can be converged to a value, which minimizes the square average value $\overline{e_i(n)^2}$ of an output signal of the second adder 117-i, by setting the gain $g_i$ of attenuator circuit 132-i to an appropriate value.

If the gain $g_i$ of attenuation circuit 132-i is set to $2^{-l}$, it is possible to form the attenuator circuit with shift-resistors. Further, the function of the attenuation circuit may be obtained by changing the connection of data transfer lines between the multiplier 130-i and the adder 134-i.

When prediction error signals applied from delay filter circuits 100-l to 100-P become larger, larger output signals are generated through the coefficient correction circuit 120-i to thereby cause coefficient output signals of the variable coefficient generating circuit 119-i to be corrected in a larger scale. Therefore, the voice analyzing apparatus as described above enables correct partial autocorrelation coefficient to be obtained even if basic parameters of voice change.

As already described referring to the equation (9), partial autocorrelation coefficient is gained by the method of successive approximation with the voice analyzing apparatus of the present invention. Duration time of a consonant is by far shorter than that of a vowel. For example, frequency spectrum of consonant shows sometimes a great change in several tens msec. Therefore, it is necessary with the voice analyzing apparatus shown in FIG. 3 that output signals K1i of the variable coefficient generating circuit 119-i of the i-th delay filter circuit 100-i, for example, are converged to the partial autocorrelation coefficient K2i as fast as possible. Gain $g_i$ of the attenuator circuit 132-i of the coefficient correction circuit 120-i may be set large to achieve this purpose. However, when gain $g_i$ is made large, residual oscillation error becomes large, and distortion is caused in synthesized voice signals. It is therefore advantageous that gain of attenuator circuit of delay filter circuit at every stage is set to an appropriate value.

Correlation between voice sampling signals is removed from the voice sampling signals in each delay filter circuit, so that average power of input signals applied to each of delay filter circuits becomes smaller and smaller as it comes to the later stage. For example, an input signal $x_{(i-1)}(n)$ applied to the i-th delay filter circuit becomes smaller than an input signal $x_{(i-m-1)}(n)$ applied to the (i−m)th delay filter circuit. An output signal $y_i(n)$ of the second adder of the i-th delay filter circuit is smaller than an output signal $y_{(i-m)}(n)$ of the second adder of the (i−m)th delay filter circuit in this case. It is therefore believed that an output signal $\{x_{(i-1)}(n)\cdot y_i(n)\}$ of the multiplier of the coefficient correction circuit of i-th delay filter circuit becomes smaller than an output signal $\{x_{(i-m-1)}(n)\cdot y_{(i-m)}(n)\}$ of the multiplier of the coefficient correction circuit of the (i−m)th delay filter circuit. Accordingly, for the purpose of making equal average values of output signals from the coefficient correction circuits of the i−th and (i−m)th delay filter circuits, the attenuator circuit of the coefficient correction circuit of the i-th delay filter circuit may be arranged to have a larger gain than the attenuator circuit of the coefficient correction circuit of the (i−m)th delay filter circuit.

According to tests, average power of input signals $x_1(n)$ of the second stage delay filter circuit is a half to a sixth of average power of input signals $x_0(n)$ applied to the first stage delay filter circuit, and average power of input signals $x_2(n)$ applied to the third stage delay filter circuit is a half to a third of average power of input signals $x_1(n)$. Average power of input signals applied to fourth to last stage delay filter circuits is almost the same as that of input signals $x_2(n)$. Therefore, when the dynamic range of input signals $x_0(n)$ is limited from −1 to +1 and coefficient supplied to first and second multipliers from the variable coefficient generating circuit of the first stage delay filter circuit is limited from −1 to +1, a gain of the attenuator circuit of delay filter circuit at every stage is advantageously set as follows: Gain $g_1$ of the attenuator circuit of first stage delay filter circuit is set to one-fourth, gain $g_2$ of the attenuator circuit of second stage delay filter circuit to a half, and gains of attenuator circuits of third and later stage delay filter circuits to 1. Or gain $g_1$ may be set to one-fourth, gain $g_2$ to 1 and other gains to 2. It is also possible to set gain $g_1$ to one-fourth and other gains to a half.

Such selection of gains enables the magnitude of correction signals supplied from the correction circuit to the coefficient generating circuit at every stage to be held constant, thus allowing partial autocorrelation coefficient to be obtained quickly and accurately.

Figure 5:
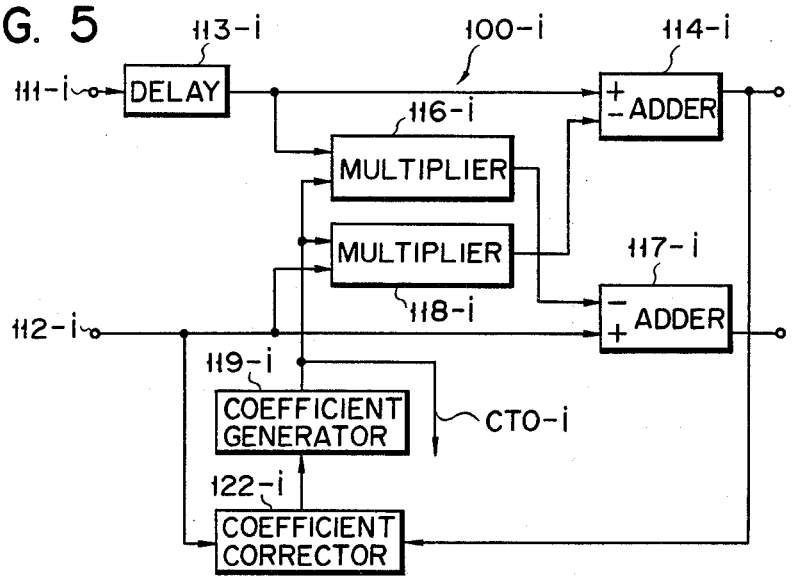
FIGS. 5 and 6 are block diagrams showing delay circuits employed in another example of voice analyzing apparatus embodied according to the present invention.

FIG. 5 shows a modification of delay filter circuit 100-i shown in FIG. 3, which is the same in arrangement as the one shown in FIG. 3 except that a coefficient correction circuit 122-i having two input terminals connected to an input terminal 112-i and the output terminal of a first adder 114-i, respectively, is employed instead of the coefficient correction circuit 120-i. The coefficient correction circuit 122-i includes a multiplier and an attenuator similar to the correction circuit 120-i shown in FIG. 4. The coefficient correction circuit 122-i in the delay filter circuit shown in FIG. 5 controls the variable coefficient generating circuit 119-i in such a way that output signals $x_i(n)\{=x_{(i-1)}(n)-K1i\cdot y_{(i-1)}(n)\}$ of the first adder 114-i are held minimum.

Figure 6:
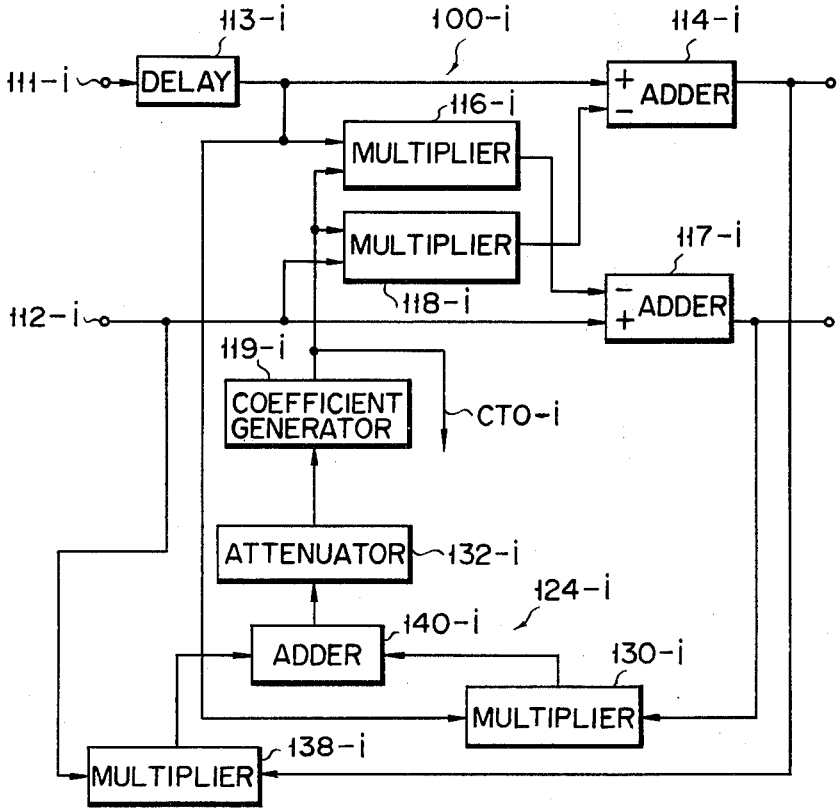

FIG. 6 shows another modification of delay filter circuit 100-i shown in FIG. 3, which is the same in arrangement as the one shown in FIG. 3 but different in that a coefficient correction circuit 124-i is used instead of the coefficient correction circuit 120-i, the coefficient correction circuit 124-i including a multiplier 138-i having two input terminals connected to an input terminal 112-i and the output terminal of a first adder 114-i, and an adder 140-i for adding an output signal of the multiplier 138-i with an output signal of a multiplier 130-i, which receives output signals of the delay circuit 113-i and a second adder 117-i, and supplying an added signal to the attenuator circuit 132-i. With the delay filter circuit shown in FIG. 6, the variable coefficient generating circuit 119-i is controlled by the coefficient correction circuit 124-i in such a way that output signals of the first and second adders 114-i and 117-i are forced to a minimum value.

Figure 7:
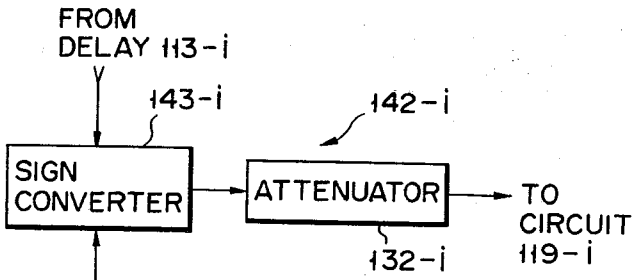
FIGS. 7 and 8 show modifications of a coefficient correction circuit employed in delay filter circuits shown in FIGS. 3 and 5.

FIG. 7 shows a coefficient correction circuit 142-i which is a modification of coefficient correction circuit 120-i employed in the delay filter circuit 100-i shown in FIG. 3. The coefficient correction circuit 142-i includes a sign converter circuit 143-i for receiving output signals of the delay circuit 113-i and adder 117-i and converting one of input signals responsive to the sign of the other, and an attenuator circuit for attenuating output signal of sign converter circuit 143-i and then supplying it to the variable coefficient generating circuit 119-i. The sign converter circuit 143-i is adapted to supply output signal of the second adder 117-i without converting it to the attenuator circuit 132-i when an output signal of the delay circuit 113-i is positive, and to convert and then supply it to the attenuator circuit 132-i when negative. To the contrary, the sign converter circuit 143-i can also be arranged to supply an output signal of delay circuit 113-i without converting it to the attenuator circuit 132-i when an output signal of the second adder 117-i is positive, and to convert and then supply it to the attenuator circuit 132-i when negative. The same effect achieved by embodiments shown in FIGS. 3 and 4 can be obtained in this case.

Figure 9:
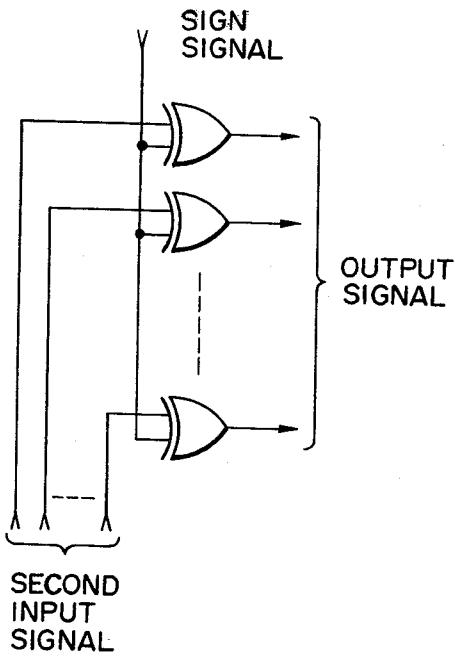
FIG. 9 shows a concrete circuit of sign converter employed in coefficient correction circuits shown in FIGS. 7 and 8.
Figure 8:
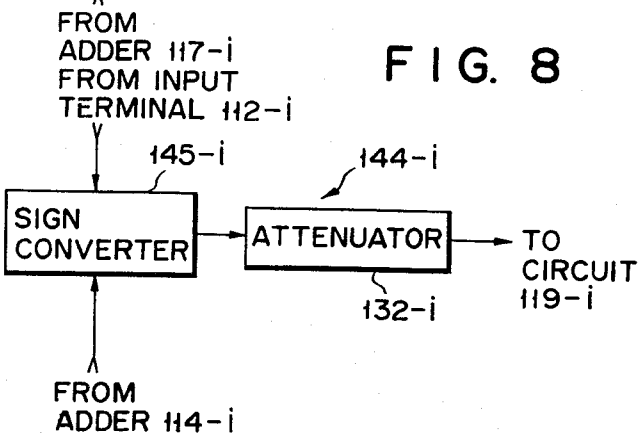

FIG. 8 shows a coefficient correction circuit 144-i which is a modification of the coefficient correction circuit 122-i employed in the delay filter circuit shown in FIG. 5. The coefficient correction circuit 144-i includes a sign converter circuit 145-i for receiving an input signal received at the input terminal 112-i and an output signal of first adder 114-i and converting one of the input signals in accordance with the sign of the other, and the attenuator circuit 132-i for attenuating output signal of sign converter circuit 145-i to supply it to the variable coefficient generating circuit 119-i. The sign converter circuit of 145-i is adapted to have the same arrangement as that of the sign converter circuit 143-i shown in FIG. 7, including a plurality of exclusive OR gates as shown in FIG. 9, for example. A signal line for transmitting a sign signal representing the sign of first input signal is commonly connected to input terminals of these exclusive OR gates, while plural bit lines for transmitting a second input signal are connected to the other input terminals thereof. Therefore, when a sign signal "0" representing the positive sign of first input signal is supplied to the exclusive OR gate circuit, a second input signal is supplied without being converted to the attenuator circuit 132, while when a sign signal "1" representing the negative sign of the first input signal is supplied to the exclusive OR gate circuit, a second input signal is converted and then supplied to the attenuator circuit 132.

Figure 10:
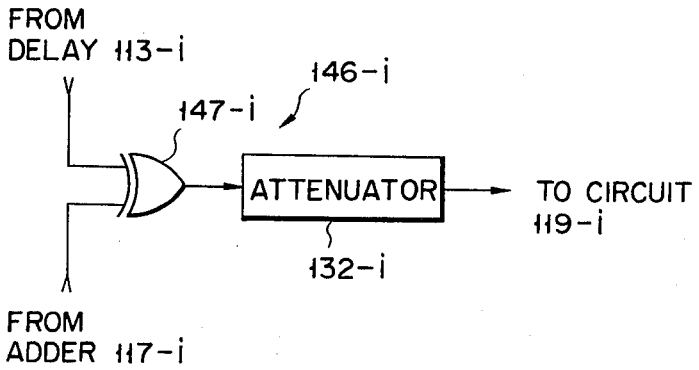
FIG. 10 and 11 show modifications of a coefficient correction circuit used in delay filter circuits shown in FIGS. 3 and 5.

FIG. 10 shows a coefficient correction circuit 146-i which is a modification of the coefficient correction circuit 122-i in the delay filter circuit of FIG. 5. The coefficient correction circuit 146-i includes an exclusive-OR gate circuit 147-i having two input terminals connected to a most significant bit line of output bit lines of the delay circuit 113-i and a most significant bit line of output bit lines of the adder 117-i. The most significant bit lines each carry a sign signal. Where output signals from the delay circuit 113-i and the adder 117-i are both positive or negative, the exclusive-OR gate circuit 147-i produces a "0" signal indicating "−1". On the other hand, where the signs of the output signals from the delay circuit 113-i and the adder 117-i are different from each other, then the exclusive-OR gate circuit 147-i produces a "1" signal indicating "+1". In this case, the attenuator circuit 132-i in any stage of the delay filter circuit has a constant gain, and produces an output signal corresponding to the product of the constant gain and an output signal from the exclusive-OR gate circuit 147-i. In this circuit, the same effect can be obtained as explained with reference to FIG. 7.

Figure 11:
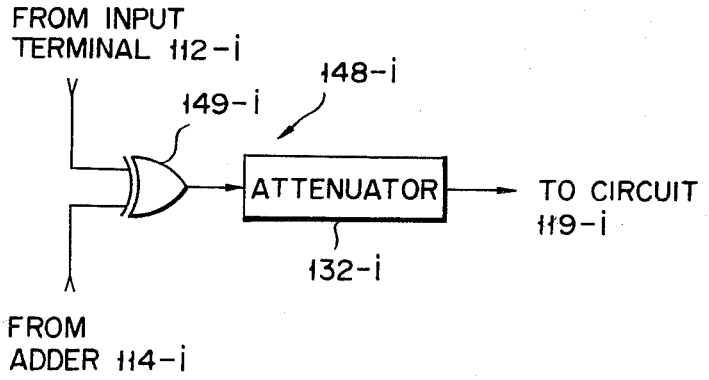

FIG. 11 shows a coefficient correction circuit 148-i which is also a modification of the coefficient correction circuit 122-i in the delay filter circuit of FIG. 5. The coefficient correction circuit 148-i includes an exclusive-OR gate circuit 149-i having two input terminals connected to a most significant bit line of output bit lines of the adder 114-i and a most significant bit line of input bit lines of the input terminal 112-i. The coefficient correction circuit 148-i functions substantially in the same manner as that shown in FIG. 10 and achieves the same effect.

It is also possible to use the exclusive-OR gate circuits 147-i and 149-i instead of the multipliers 130-i and 138-i in FIG. 6.

Figure 12:
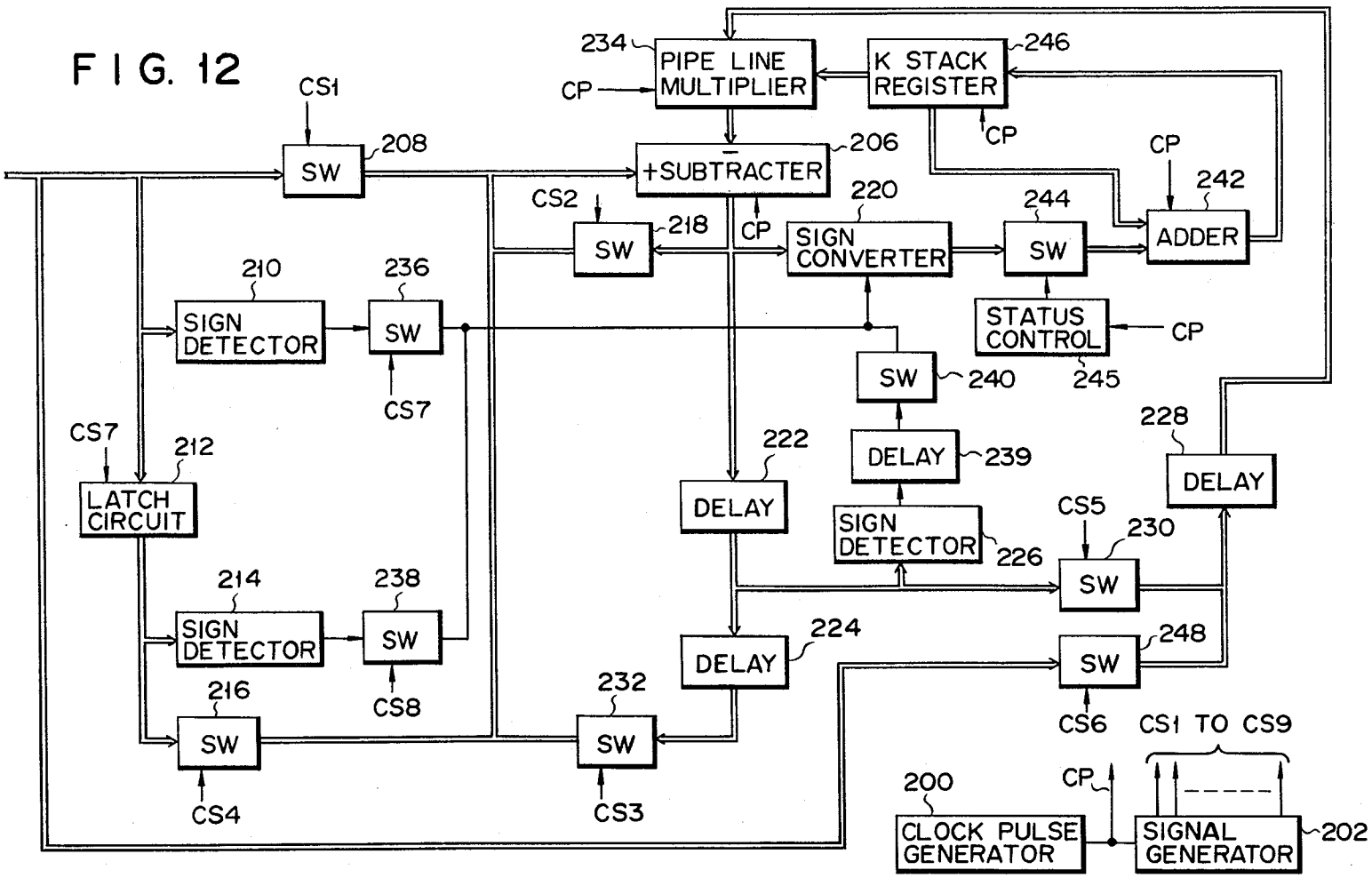
FIG. 12 is a block diagram showing another example of voice analyzing apparatus embodied according to the present invention.

FIG. 12 shows an example of voice analyzing apparatus embodied according to the present invention, which is simple in arrangement and operates time-sequentially in response to timing signals applied from a timing signal generator 200 so as to achieve the same operation and effect as those achieved when the voice analyzing apparatus shown in FIG. 3 is comprised by delay filter circuits of ten stages.

Figures 13A, 13B, 13C, 13D, 13E, 13F, 13G, 13H, 13I, 13J:
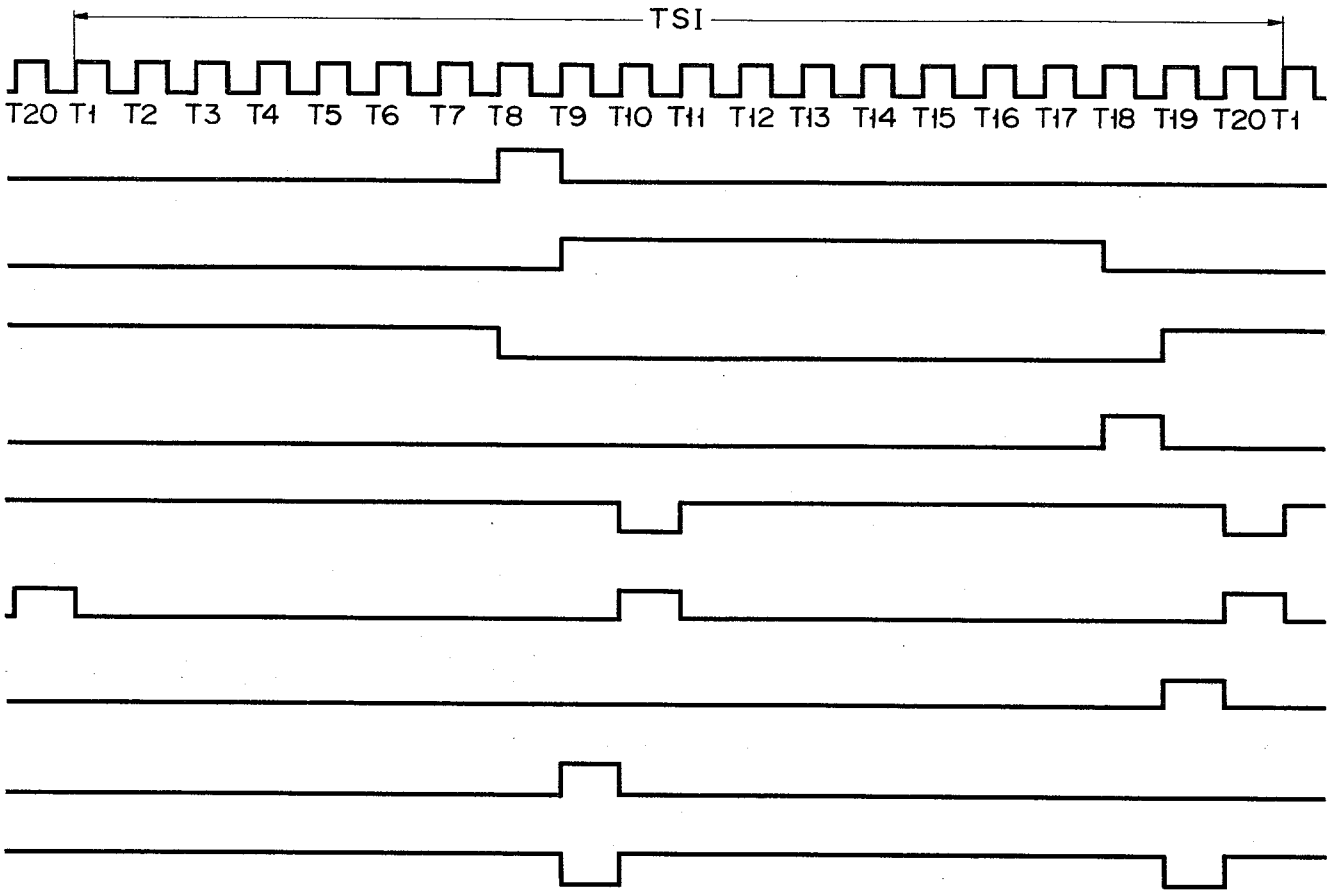
FIGS. 13A through 13J show waveforms of control signal for controlling the operation of voice analyzing apparatus shown in FIG. 12.

The voice analyzing apparatus includes the clock pulse generator 200, and a signal generator 202 for generating control signals TS1 to TS9 as shown in FIGS. 13B through 13J responsive to a clock pulse CP, which is applied from the clock pulse generator 200 and has a cycle T as shown in FIG. 13A. Sampling data received by the voice analyzing apparatus are supplied via a switch 208 to the first or positive input terminal of a subtracter 206 while to a sign detector 210 and a latch circuit 212. Output signal of latch circuit 212 is supplied to a sign detector 214 while via a switch 216 to the first input terminal of the subtracter 206. An output signal of the subtracter 206 is supplied via a switch 218 to the first input terminal thereof, and to a sign converter 220 and a delay circuit 222 having a delay time 2T. An output signal of delay circuit 222 is supplied via a delay circuit 224 which has a delay time 9T, a sign detector 226 and a switch 230 to a delay circuit 228 which has a delay time T. An output signal of the delay circuit 224 is applied via a switch 232 to the first input terminal of the subtracter 206, while an output signal of the delay circuit 228 to a pipe line multiplier 234 of seven stages. An output signal of the pipe line multiplier 234 is applied to the second or negative input terminal of the subtracter 206. Output signals of the sign detectors 210 and 214 are supplied via switches 236 and 238, while an output signal of the sign detector 226 via a delay circuit 239 having a delay time 9T and a switch 240, to the sign converter 220, respectively. An output signal of the sign converter 220 is applied via a switch 244 to the first input terminal of an adder 242. The switch 244 is controlled by a status control circuit 245 which generates a switching status control signal responsive to the clock pulse CP of the clock pulse generator 200, to change the switching state between the output terminal of the sign converter 220 and the second input terminal of the adder 242. Assume that the output terminal of the sign converter 220 has eight output bit lines and the second input terminal of adder 242 ten input bit lines. In this case, the eight output bit lines of the sign converter 220 are connected via the switch 244 to lower eight bit lines of the ten input ones of the adder 242 when operation is being carried out corresponding to the operation in the first stage delay filter circuit, and the eight output bit lines of the sign converter 220 are connected via the switch 244 to eight input bit lines which are obtained by excluding most and least significant bit lines from the ten input bit lines of the adder 242 when operation is being carried out corresponding to the operation in the second stage delay filter circuit. Further, the eight output bit lines of the sign converter 220 are connected via the switch 244 to higher eight input bit lines of the second input terminal of the adder 242 when operation is being carried out corresponding to any one of operations in the third and later stage delay filter circuits. Namely, the switch 244 and status control circuit 245 serve to function as the attenuator employed in the delay filter circuit of FIG. 3 with their gains arranged changeable.

An output signal of adder 242 is supplied to a K stack register 246 whose output signal is supplied to the second input terminal of the pipe line multiplier 234 and adder 242 and which may be formed of shift registers of nine stages driven in response to the clock pulse CP from the clock pulse generator circuit 200. Sampling data received by the voice analyzing apparatus are also supplied via a switch 248 to the delay circuit 228.

Each of the sign detectors 210, 214 and 229 can be formed of a line, for example, connected to the most significant bit line of input data paths, the most significant bit line serving to transmit a signal. When first stage coefficient data $K_1$ is generated through the adder 242, for example, the K stack register 246 stores second to tenth coefficient data $K_2$ to $K_{10}$ in the first to ninth stages thereof, respectively, supplies these coefficient data $K_1$ to $K_{10}$ successively to the adder 242 from the last stage thereof responsive to clock pulses CP, and supplies coefficient compound data from first to fifth stages thereof to the pipe line multiplier 234, the coefficient compound data representing part of these coefficient data.

The operation of voice analyzing apparatus shown in FIG. 12 will be described referring to FIGS. 13A through 13J. An operation corresponding to that of the first stage delay filter circuit of the voice analyzing apparatus shown in FIG. 3 will be described firstly.

Sampling data S(n−1) received in a previous sampling data receiving time period TS(n−1) is latched by the latch circuit 212 responsive to the control signal CS7 shown in FIG. 13H, and supplied via the switch 248, which is closed at a timing T20 in response to the switch control signal shown in FIG. 13G, to the pipe line multiplier 234 at a timing T1 of this sampling data receiving time period TS(n) after they are delayed by a time T by the delay circuit 228. Further, the switch 248 is closed at a timing T10 of this time period TS(n) and sampling data S(n) is supplied at a timing T11 to the pipe line multiplier 234. This multiplier 234 multiplies sampling data $S(n-1)$ received at a timing T1 by first stage coefficient $K_{1L}(n-1)$ now generated from the K stack register 246 to generate output data $\{K_{1L}(n-1)\cdot S(n-1)\}$ at a timing T8, and also multiplies sampling data $S(n)$ received at a timing T11 by first stage coefficient $K_{1F}(n)$ which is derived from and stored in the K stack register 246 as will be described later, to generate output data $\{K_{1F}(n)\cdot S(n)\}$ at a timing T18. These output data correspond to those generated through first and second multipliers (not shown) in the first stage delay filter circuit 100-1 shown in FIG. 3.

Output data $\{K_{1L}(n-1)\cdot S(n-1)\}$ generated by the pipe line multiplier 234 at the timing T8 and sampling data $S(n)$ supplied via the switch 208 which is closed at the timing T8 by the switch control signal CS1 shown in FIG. 13B are supplied to the second and first input terminals of the subtracter 206, respectively. Therefore, the subtracter 206 generates at a timing T9 output data $F_1(n)\{=S_1(n)-K_{1L}(n-1)\cdot S(n-1)\}$. This output data $F_1(n)$ is supplied via the switch 218, which is closed by the switch control signal CS2 shown in FIG. 13C, to the first input terminal of subtracter 206 at the timing T9 and, after delayed by a time 2T through the delay circuit 222, via the switch 230, which is closed by the switch control signal CS5 shown in FIG. 13F, to the delay circuit 228, where it is further delayed by a time T and then supplied to the pipe line multiplier 234 at a timing T12.

On the other hand, output data $K_{1F}(n)\cdot S(n)$ generated through the pipe line multiplier 234 at the timing T18 is subtracted from signal $S(n-1)$ which is supplied via the switch 216 to the first input terminal of the subtracter 206, the switch 216 being closed in response to the switch control signal CS4 at the timing T18. Therefore, the subtracter 206 generates output data $B_1(n)\{=S(n-1)-K_{1F}(n)\cdot S(n)\}$ at a timing T19. This output data $B_1(n)$ is delayed through the delay circuit 222 by a time 2T and then supplied via the switch 230, which is closed in response to the switch control signal CS5 at the timing T1 of a next sampling data receiving time period TS2, to the delay circuit 228, where it is further delayed by a time T and then supplied to the pipe line multiplier 234 at a timing T2. This output data $B_1(n)$ is still further delayed through delay circuits 222 and 224 by a time 11T and then also supplied via the switch 232, which is closed by the switch control signal CS3 shown in FIG. 13D at the timing T19 of sampling data receiving time period TS2, to the first input terminal of the subtracter 206.

The sign converter circuit 220 receives output data $F_1(n)$ of the subtracter 206 at the timing T9 and converts the sign of output data $F_1(n)$ in response to a signal representing the sign of output signal $S(n-1)$ which is supplied to the latch circuit 212 through the switch 238, which is closed by the switch control signal CS8 shown in FIG. 13I. When the value of output signal $S(n-1)$ of the latch circuit 212 is positive, for example, output data $F_1(n)$ is supplied, without being sign-converted, via the switch 244 to the first input terminal of the adder 242, but when the value is negative, output data $F_1(n)$ is sign-converted or inverted and then supplied to the first input terminal of the adder 242 through the switch 244. Namely, supplied to the first input terminal of the adder 242 is input signal $g_1\cdot F_1(n)\cdot sgn\{S(n-1)\}$, where $g_1$ represents the ratio of an input signal applied to the adder 242 relative to an output signal applied from the sign converter 220 in the first stage operation, the ratio being $2^{-2}$ in this case, and $sgn\{S(n-1)\}$ the sign of signal $S(n-1)$, the $sgn\{S(n-1)\}$ becoming $+1$ and $-1$, respectively, when $S(n-1)$ is positive and negative.

The adder 242 adds input signal $g_1\cdot F_{11}(n)\cdot sgn\{S(n-1)\}$ applied to the first input terminal thereof to input signal $K_{1L}(n-1)$ and supplies output signal $K_{1F}(n)[=K_{1L}(n-1)+g_1\cdot F_1(n)\cdot sgn\{S(n-1)\}]$ to the K stack register 246 at the timing T10. This coefficient $K_{1F}(n)$ is thus stored, as a new first stage coefficient, in the K stack register 246 and multiplied, as described above, by sampling data $S(i)$ received by the pipe line multiplier 234 at the timing T11.

As described above, the sign converter 220 which has received output data $B_1(n)$ generated through the subtracter 206 at the timing T9 supplies output signal $[g_1\cdot B_1(n)\cdot sgn\{S(n)\}]$ to the first input terminal of the adder 242 responsive to a signal which represents the sign of sampling data $S(n)$ and which is supplied from the sign detector 210 through the switch 236 closed at the timing T19 in response to the switch control signal CS7 shown in FIG. 13H. The adder 242 adds an output signal applied from the sign converter 220 to first stage coefficient signal $K_{1F}(n)$ now generated through the K stack resister 246 and supplies this added output signal $[K_{1F}(n)+g_1\cdot B_1(n)\cdot sgn\{S(n)\}]$, as a new first stage coefficient $K_{1L}(n)$ to be stored, to the K stack register 246 at the timing T20. The operation relating to first stage backward and forward prediction errors $B_1$ and $F_1$, and first stage coefficient $K_1$ is thus finished carrying out coefficient calculation two times in a sampling data receiving time period.

Operation corresponding to the coefficient operation in the delay filter circuit of second stage can be achieved similar to the above-described first stage coefficient operation but different in the selection of switches.

The pipe line multiplier 234 multiplies signal $B_1(n-1)$ received from the delay circuit 228 at a timing T2 by second stage coefficient $K_{2L}(n-1)$ received from the K stack register 246 to supply output signal $K_{2L}(n-1)\cdot B_1(n-1)$ to the subtractor 206 at the timing T9. On the other hand, the subtracter 206 has signal $F_1(n)$ received at the first input terminal thereof through the switch 218 at the timing T9 to thereby generate output signal $F_2(n)\{=F_1(n)-K_{2L}(n-1)\cdot B_1(n-1)\}$. This output signal $F_2(n)$ is supplied to the sign converter 220, which generates output signal $[F_2(n)\cdot sgn\{B_1(n-1)\}]$ responsive to a signal representing the sign of signal $B_1(n-1)$ and being transmitted through the switch 240 closed at the timing T9 in response to the switch control signal CS9 shown in FIG. 13J. As described above, eight output bit lines of the sign converter 220 are connected via the switch 244 to second through ninth ones of the ten input bit lines of the first input terminal of adder 242 in the second stage coefficient calculating operation, so that input signal $[g_2\cdot F_2(n)\cdot sgn\{B_1(n-1)\}]$ wherein $g_2$ is $2^{-1}$ in this case is supplied to the adder 242, which adds input signal $[g_2\cdot F_2(n)\cdot sgn\{B_1(n-1)\}]$ supplied to the first input terminal thereof to input signal $\{K_{2L}(n-1)\}$ supplied to the second input terminal thereof from the K stack register 246 to supply an output signal $K_{2F}(n)[=K_{2L}(n-1)+g_2\cdot F_2(n)\cdot sgn\{B_1(n-1)\}]$ to the K stack register 246 where it is stored as a new second stage coefficient at the timing T10.

Similarly, the pipe line multiplier 234 receives at a timing T12 signal $F_1(n)$ transmitted from the subtractor 206 through delay circuits 222 and 228, and multiplies it by second stage coefficient $K_{2F(n)}$ now generated through the K stack register 246 to thereby generate output signal $\{K_{2F}(n)\cdot F_1(n)\}$ at the timing T19. The subtracter 206 subtracts this output signal $\{K_{2F}(n)\cdot F_1(n)\}$ from signal $\{B_1(n-1)\}$ supplied through the switch 232 which is closed at the timing T19 to generate output signal $B_2(n)\{=B_1(n-1)-K_{2F}(n)\cdot F_1(n)\}$ at the timing T20. This output signal $B_2(n)$ is supplied to the sign converter 220, which generates output signal $\{B_2(n)\cdot F_1(n)\}$ responsive to a signal representing the sign of signal $F_1(n)$ and being transmitted through the switch 240 closed at the timing T20. As the result, the adder 242 adds input signal $\{g_2\cdot B_2(n)\cdot F_1(n)\}$ supplied to the first input terminal thereof to input signal $\{K_{2F}(n)\}$ supplied from the K stack register 246 to the second input terminal thereof to generate output signal $K_{2L}(n)\{=K_{2F}(n)+g_2\cdot B_2(n)\cdot F_1(n)\}$, which is stored in the K stack register 246 at the timing T1 of a next sampling data receiving time period $TS(n+1)$.

The operation relating to second stage backward and forward prediction errors $B_2$ and $F_2$ and second stage coefficient $K_2$ is thus finished carrying out two-time coefficient operations in a sampling data receiving time period, the coefficient operations being totalled twenty times.

Figure 14:
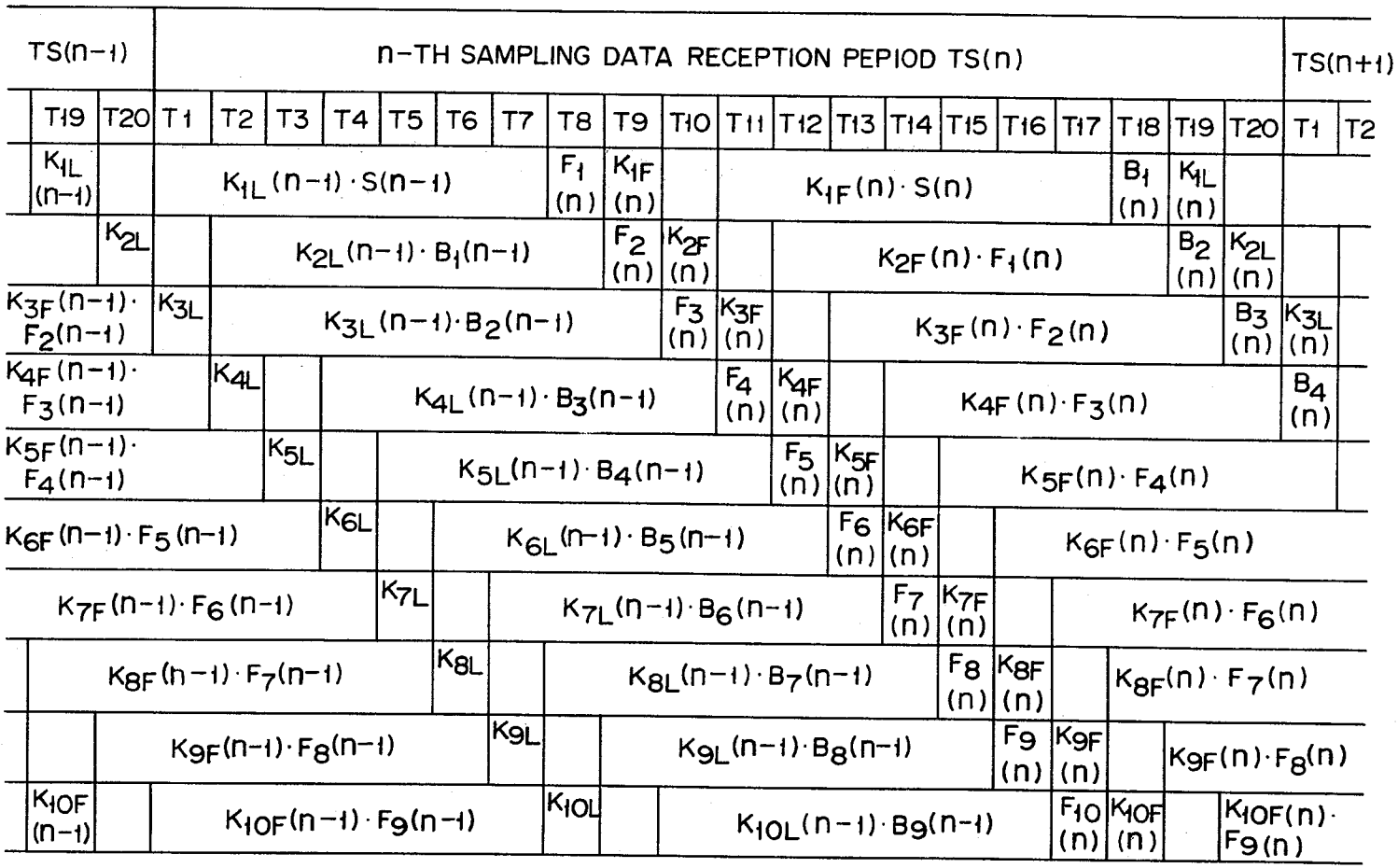
FIG. 14 is a calculating operation chart showing periods of calculating operation of voice analyzing apparatus shown in FIGS. 13A through 13J.

Similarly, operations relating to backward and forward prediction errors and coefficients from third to tenth stages are carried out as shown in the operation chart of FIG. 14.

Although the present invention has been described referring to embodiments thereof, is should be understood that the present invention is not limited to these embodiments. For example, sign converters 143-i and 145-i shown in FIGS. 7 and 8 may be used instead of the multipliers 130-i and 138-i, respectively. Sign detectors 210 and 214 shown in FIG. 12 may be removed to use a multiplier instead of the sign converter 220.

What is claimed is:

1. A voice analyzing apparatus comprising a plurality of cascade-connected delay filter circuit each including:

a delay circuit connected to delay an input signal received at a first input terminal by a predetermined period of time;

a variable coefficient generating circuit;

a first multiplier circuit connected to produce an output signal corresponding to the product of output signals from said delay circuit and said variable coefficient generating circuit;

a second multiplier circuit connected to produce an output signal corresponding to the product of output signals from said delay circuit and said variable coefficient generating circuit and an input signal received at a second input terminal;

a first adder circuit connected to produce an output signal coresponding to the sum of or the difference between output signals from said delay circuit and said second multiplier circuit;

a second adder circuit connected to produce an output signal corresponding to the sum of or the difference between the output signal from said first multiplier circuit and an input signal received at said second input terminal; and a coefficient correction circuit connected to said variable coefficient generating circuit and including a first coefficient control signal generating circuit having two inputs connected to the output terminals of said delay circuit and said second adder circuit to produce a coefficient control signal to change a coefficient output signal from said variable coefficient generating circuit to suppress an output signal from said second adder circuit to the minimum and an attenuator circuit connected to attenuate the coefficient control signal generated from said coefficient control signal generating circuit.

2. A voice analyzing apparatus according to claim 1, wherein said first coefficient control signal generating circuit includes a third multiplier having two input terminals connected to output terminals of said delay circuit and said second adder circuit, and an output terminal connected to said attenuator circuit.

3. A voice analyzing apparatus comprising a plurality of cascade-connected delay filter circuits each including:

a delay circuit connected to delay an input signal received at a first input terminal by a predetermined period of time;

a variable coefficient generating circuit;

a first multiplier circuit connected to produce an output signal corresponding to the product of output signals from said delay circuit and said variable coefficient generating circuit;

a second multiplier circuit connected to produce an output signal corresponding to the product of output signals from said delay circuit and said variable coefficient generating circuit and an input signal received at a second input terminal;

a first adder circuit having an output terminal and connected to produce an output signal corresponding to the sum of or the difference between output signals from said delay circuit and said second multiplier circuit;

a second adder circuit connected to produce an output signal corresponding to the sum of or the difference between the output signal from said first multiplier circuit and an input signal received at said second input terminal; and a coefficient correction circuit connected to said variable coefficient generating circuit and including a coefficient control signal generating circuit having two input terminals connected to said second input terminal and the output terminal of said first adder circuit to produce a coefficient control signal to change a coefficient output signal from said variable coefficient generating circuit to suppress the output signal from said first adder circuit to the minimum and an attenuator circuit connected to attenuate the coefficient control signal generated from said coefficient control signal generating circuit.

4. A voice analyzing apparatus according to claim 1, wherein said coefficient correction circuit further includes a second coefficient control signal generating circuit having two input terminals connected to said second input terminal and the output terminal of said first adder circuit to produce a coefficient control signal to change a coefficient output signal from said variable coefficient generating circuit to suppress an output signal from said first adder circuit to the minimum and a third adder circuit connected to receive output signals from said first and second coefficient control signal generating circuits and supply an output signal to said first attenuator circuit.

5. A delay filter circuit for a voice analyzing apparatus comprising:

a delay circuit connected to delay an input signal received at a first input terminal by a predetermined period of time;

a variable coefficient generating circuit;

a first multiplier circuit connected to produce an output signal corresponding to the product of output signals from said delay circuit and said variable coefficient generating circuit;

a second multiplier circuit connected to produce an output signal corresponding to the product of an output signal from said variable coefficient generating circuit and an input signal received at a second input terminal;

a first adder circuit having an output terminal and connected to produce an output signal corresponding to the sum of or the difference between output signals from said delay circuit and said second multiplier circuit;

a second adder circuit connected to produce an output signal corresponding to the sum of or the difference between the output signal from said first multiplier circuit and an input signal received at said second input terminal; and a coefficient correction circuit connected to said variable coefficient generating circuit and including a coefficient control signal generating circuit having two input terminals connected to said second input terminal and the output terminal of said first adder circuit to produce a coefficient control signal to change a coefficient output signal from said variable coefficient generating circuit to suppress an output signal from said first adder circuit to the minimum and an attenuator circuit connected to attenuate the coefficient control signal generated from said coefficient control signal generating circuit.

6. A voice analyzing apparatus according to claim 3, wherein said first coefficient control signal generating circuit includes a third multiplier having two input terminals connected to an output terminal of said first adder circuit and said second input terminal, and an output terminal connected to said attenuator circuit.

7. A voice analyzing apparatus according to claim 4, wherein said first coefficient control signal generating circuit indluces:

a third multiplier having two input terminals connected to output terminals of said delay circuit and said second adder circuit, and an output terminal connected to said third adder circuit; and wherein said second coefficient control signal generating circuit includes:

a fourth multiplier having two input terminals connected to an output signal of said first adder circuit and said second input terminal, and an output terminal connected to said third adder circuit.

8. A voice analyzing apparatus according to claim 1, wherein said first coefficient control signal generating circuit includes a sign converting circuit having two input terminals connected to output terminals of said delay circuit and said second adder circuit, and supplies to said attenuator circuit an output signal which has an absolute value substantially equal to that of one of two input signals supplied thereto and which has the same sign as the sign of the product of the two input signals.

9. A voice analyzing apparatus according to claim 3 wherein said coefficient control signal generating circuit includes a sign converting circuit having two input terminals connected to an output terminal of said first adder circuit and said second input terminal, and supplies to said attenuator circuit an output signal which has an absolute value substantially equal to that of one of two input signals supplied thereto and which has the same sign as the sign of the product of the two input signals.

10. A voice analyzing apparatus according to claim 4, wherein said first coefficient control signal generating circuit includes:

a first sign converting circuit having two input terminals connected to output terminals of said delay circuit and said second adder circuit, and supplying to said third adder circuit an output signal which has an absolute value substantially equal to that of one of two input signals supplied thereto and which has the same sign as the sign of the product of the two input signals; and a second sign converting circuit having two input terminals connected to an output terminal of said first adder circuit and said second input terminal, and supplying to said third adder circuit an output signal which has an absolute value substantially equal to that of one of two input signals supplied thereto and which has the same sign as the sign of the product of the two input signals.

11. A voice analyzing apparatus according to claim 1 or claim 2 or claim 6 or claim 7 or claim 8 or claim 9 or claim 10 or claim 3 or claim 4, wherein said cascade-connected delay filter circuits include at least a first stage and a second stage, said first attenuator circuit includes at least a first stage attenuator circuit and a second stage attenuator circuit, said first stage attenuator circuit having a smaller gain than said second stage attenuator circuit.

12. A voice analyzing apparatus according to claim 11, wherein said cascade-connected delay filter circuits further include at least a third stage, and said first attenuator circuit further includes at least a third stage attenuator circuit;

said third stage attenuator circuit having a gain greater than said first stage attenuator circuit or said second stage attenuator circuit, and any successive stage attenuator circuits from said third stage attenuator circuit having a gain substantially equal to the gain of said third stage attenuator circuit.

13. A voice analyzing apparatus according to claim 1 or claim 2 or claim 6 or claim 7 or claim 8 or claim 9 or claim 10, or claim 2 or claim 4, wherein said cascade-connected delay filter circuits include a plurality of successive delay filter circuit stages, and said attenuator circuit includes a respective attenuator circuit for each of said successive delay filter circuit stages, each respective attenuator circuit having a gain equal to or greater than the gain of a preceding respective attenuator circuit.

14. A voice analyzing apparatus according to claim 1, wherein said first coefficient control signal generating circuit includes an exclusive-OR gate circuit connected to receive sign signals indicating signs of output signals from said delay circuit and said second adder circuit, and supply an output signal to said attenuator circuit.

15. A voice analyzing apparatus according to claim 3 wherein said coefficient control signal generating circuit includes an exclusive-OR gate circuit connected to receive sign signals indicating a sign of an output signal from said first adder circuit and a sign of an input signal received by said second input terminal, and supply an output signal to said attenuator circuit.

16. A voice analyzing apparatus according to claim 4, wherein said first coefficient control signal generating circuit includes:

a first exclusive-OR gate circuit connected to receive sign signals indicating signs of output signals from said delay circuit and said second adder circuit and supply an output signal to said third adder circuit; and wherein said second coefficient control signal generating circuit includes:

a second exclusive-OR gate circuit connected to receive sign signals indicating a sign of an output signal from said first adder circuit and a sign of an input signal received by said second input terminal and supply an output signal to said third adder circuit.

17. A delay filter circuit for a voice analyzing apparatus comprising:

a delay circuit connected to delay an input signal received at a first input terminal by a predetermined period of time;

a variable coefficient generating circuit;

a first multiplier circuit connected to produce an output signal corresponding to the product of output signals from said delay circuit and said variable coefficient generating circuit;

a second multiplier circuit connected to produce an output signal corresponding to the product of an output signal from said variable coefficient generating circuit and an input signal received at a second input terminal;

a first adder circuit connected to produce an output signal corresponding to the sum of or the difference between output signals from said delay circuit and said second multiplier circuit;

a second adder circuit connected to produce an output signal corresponding to the sum of or the difference between the output signal from said first multiplier circuit and an input signal received at said second input terminal; and a coefficient correction circuit connected to said variable coefficient generating circuit and including a first coefficient control signal generating circuit having two inputs connected to the output terminals of said delay circuit and said second adder circuit to produce a coefficient control signal to change a coefficient output signal from said variable coefficient generating circuit to suppress an output signal from said second adder circuit to the minimum and an attenuator circuit connected to attenuate the coefficient control signal generated from said coefficient control signal generating circuit.

18. A delay filter circuit according to claim 17, wherein said first coefficient conrol generating circuit includes a third multiplier having two input terminals connected to output terminals of said delay ciruit and said second adder circuit, and an output terminal connected to said attenuator circuit.

19. A delay filter circuit according to claim 5, wherein said first coefficient control signal generating circuit includes a third multiplier having two input terminals connected to an output terminal of said first adder circuit and said second input terminal, and an output terminal connected to said attenuator circuit.

20. A delay filter circuit according to claim 5, wherein said first coefficient control signal generating circuit includes:

a third multiplier having two input terminals connected to output terminals of said delay circuit and said second adder circuit, and an output terminal connected to said third adder circuit; and wherein said second coefficient control signal generating circuit includes:

a fourth multiplier having two input terminals connected to an output signal of said first adder circuit and said second input terminal, and an output terminal connected to said third adder circuit.

21. A delay filter circuit according to claim 7, wherein said first coefficient control signal generating circuit includes a sign converting circuit having two input terminals connected to output terminals of said delay circuit and said second adder circuit, and supplies to said attenuator circuit an output signal which has an absolute value substantially equal to that of one of two input signals supplied thereto and which has the same sign as the sign of the product of the two input signals.

22. A delay filter circuit according to claim 5, wherein said coefficient control signal generating circuit includes a sign converting circuit having two input terminals connected to an output terminal of said first adder circuit and said second input terminal and supplies to said attenuator circuit an output signal which has an absolute value substantially equal to that of one of two input signals supplied thereto and which has the same sign as the sign of the product of the two input signals.

23. A delay filter circuit according to claim 5, wherein said first coefficient control signal generating circuit includes:

a first sign converting circuit having two input terminals connected to output terminals of said delay circuit and said second adder circuit, and supplying to said third adder circuit an output signal which has an absolute value substantially equal to that of one of two input signals supplied thereto and which has the same sign as the sign of the product of the two input signals; and a second sign converting circuit having two input terminals connected to an output terminal of said first adder circuit and said second input terminal, and supplying to said third adder circuit an output signal which has an absolute value substantially equal to that of one of two input signals supplied thereto and which has the same sign as the sign of the product of the two input signals.

24. A delay filter circuit according to claim 17, wherein said first coefficient control signal generating circuit includes an exclusive-OR gate circuit connected to receive sign signals indicating signs of output signals from said delay circuit and said second adder circuit, and supply an output signal to said attenuator circuit.

25. A delay filter circuit according to claim 5, wherein said first coefficient control generating circuit includes an exclusive-OR gate circuit connected to receive sign signals indicating a sign of an output signal from said first adder circuit and a sign of an input signal received by said second input terminal, and supply an output signal to said attenuator circuit.

26. A delay filter circuit according to claim 5, wherein said first coefficient control signal generating circuit includes:

a first exclusive-OR gate circuit connected to receive sign signals indicating signs of output signals from said delay circuit and said second adder and supply an output signal to said third adder circuit; and wherein said second coefficient control signal generating circuit includes:

a second exclusive-OR gate circuit connected to receive sign signals indicating a sign of an output signal from said first adder circuit and a sign of an input signal received by said second input terminal and supply an output signal to said third adder circuit.

27. A voice analyzing apparatus comprising:

first and second data holding means (input terminal, 212) adapted to hold successive sampling data, respectively and generate the sampling data with a preset delay time from each other;

register means (246) producing a coefficient output signal;

multiplier means (234) having a pair of input terminals and connected to receive one of output signals from said first and second data holding means at one input terminal and an output signal from said register means at the other input terminal to produce an output signal corresponding to the product of to input signals;

subtraction means (206) connected to receive one of output signals from said first and second data holding means and an output signal from said multiplier means to produce an output signal corresponding to a difference between two input signals;

coefficient correction means (210, 214, 220, 226) connected to receive one of output signals from said first and second data holding means and an output signal from said substraction means and producing a correction output signal;

adding means (242) connected to receive output signals from said register means and coefficient correction means to produce a coefficient output signal which corresponds to the sum of two input signals and is stored in said register means, the output signal from said coefficient correction means being determined to increase an output signal from said register means when the sign of the product of the input signal to the first input terminal of said multiplier means and an output signal from said subtraction means is positive, and decrease the output signal from said register means when the sign of the product of the input signal to the first input terminal of said multiplier means and an output signal from said subtraction means is negative; and time-sequence control means (200,202,208,216, 218, 230, 232, 248), adapted to permit an output signal from said first data holding means to be supplied to said multiplier means and coefficient correction means and an output signal from said second data holding means to be supplied to said substraction means in a first operation mode in each operation cycle, and permit a signal corresponding to an output signal from said second data holding means to be supplied to said multiplier means and coefficient correction means and an output signal from said first data holding means to be supplied to said subtraction means in a second operation mode in each operation cycle.

28. A voice analyzing apparatus according to claim 27, wherein said coefficient correction means includes a sign converting circuit producing an output signal which has an absolute value substantially equal to that of an output signal from said multiplier means and which has a sign determined by the sign of an output signal supplied from one of said first and second data holding means, and an attenuator circuit connected to attenuate an output signal from said sign converting circuit.

29. A voice analyzing apparatus according to claim 27 or 28, which further comprises third data holding means for holding an output signal generated from said subtraction means in the second operation mode in a preceding operation cycle and fourth data holding means for holding an output signal generated from said subtraction means in the first operation mode in the present operation cycle, and in which said register means is formed of a shift register of plural stages sequentially and cyclically producing a plurality of coefficient signals and said time sequence control means permits an output signal from said fourth data holding means to be supplied to said multiplier means and coefficient correction means and an output signal from said third data holding means to be supplied to said subtraction means in a third operation mode in each operation cycle and permits an output signal from said third data holding means to be supplied to said multiplier means and coefficient correction means and an output signal from said fourth data holding means to be supplied to said subtraction means in a fourth operation mode in each operation cycle.

30. A delay filter circuit according to claim 17, wherein said coefficient correction circuit further includes a second coefficient control signal generating circuit having two input terminals connected to said second input terminal and the output terminal of said first adder circuit to produce a coefficient control signal to change a coefficient output signal from said variable coefficient generating circuit to suppress an output signal from said first adder circuit to the minimum and a third adder circuit connected to receive output signals from said first and second coefficient control signal generating circuits and supply an output signal to said first attenuator circuit.

31. A voice analyzing apparatus according to claim 24, wherein said coefficient correction means includes a multiplier circuit connected to produce a correction output signal substantially equal to the product of one of the output signals from said first and second data holding means and an output signal from said subtraction means.

* * * * *